US008421365B2

(12) United States Patent
Kong et al.

(10) Patent No.: US 8,421,365 B2
(45) Date of Patent: Apr. 16, 2013

(54) APPARATUS FOR DRIVING LIGHT EMITTING DEVICE USING PULSE-WIDTH MODULATION

(75) Inventors: Seung Kon Kong, Gyunggi-do (KR); Jae Shin Lee, Gyunggi-do (KR); Jung Hyun Kim, Gyunggi-do (KR); Jung Sun Kwon, Gyunggi-do (KR); Bo Hyun Hwang, Seoul (KR)

(73) Assignee: Samsung Electro-Mechanics Co., Ltd. (KR)

( * ) Notice: Subject to any disclaimer, the term of this patent is extended or adjusted under 35 U.S.C. 154(b) by 426 days.

(21) Appl. No.: 12/770,953

(22) Filed: Apr. 30, 2010

(65) Prior Publication Data

US 2011/0140627 A1 Jun. 16, 2011

(30) Foreign Application Priority Data

Dec. 16, 2009 (KR) ..... 10-2009-0125656

(51) Int. Cl.
*H05B 39/02* (2006.01)

(52) U.S. Cl.
USPC ..... 315/209 R; 315/299; 315/307; 315/308

(58) Field of Classification Search ..... 315/119, 315/121, 122, 123, 127, 128, 185 R, 186, 315/192, 209 R, 210, 225, 226, 291, 294, 315/297, 299, 300, 301, 302, 306, 307, 308, 315/312, 313, 320, 361, 362
See application file for complete search history.

(56) References Cited

U.S. PATENT DOCUMENTS

| | | | | |
|---|---|---|---|---|
| 6,400,101 | B1 | 6/2002 | Biebl et al. | |
| 6,724,158 | B1 | 4/2004 | Feldman | |
| 8,044,609 | B2 * | 10/2011 | Liu | 315/291 |
| 2006/0164366 | A1 | 7/2006 | Yu et al. | |
| 2009/0045758 | A1 | 2/2009 | Chida | |

FOREIGN PATENT DOCUMENTS

| | | |
|---|---|---|
| JP | 2003504797 | 2/2003 |
| JP | 2006339507 | 12/2006 |

OTHER PUBLICATIONS

Japanese Office Action for Application No. 2010-106998 mailed Jul. 24, 2012.

* cited by examiner

*Primary Examiner* — Douglas W Owens
*Assistant Examiner* — Jianzi Chen
(74) *Attorney, Agent, or Firm* — Lowe Hauptman Ham & Berner, LLP

(57) ABSTRACT

An apparatus for driving a light emitting device (LED) is provided. The apparatus for driving the LED includes a first driving control element, a first current detection unit, a first effective value detection unit, a first reference signal generation unit, and a first comparison unit. The first driving control element controls a current flowing through a first LED channel, in response to a first pulse-width modulated control signal. The first current detection unit detects the current flowing through the first LED channel. The first effective value detection unit detects an effective value of the current detected by the first current detection unit. The first reference signal generation unit generates a preset reference signal having a sawtooth waveform. The first comparison unit compares the reference signal from the first reference signal generation unit with the effective value from the first effective value detection unit.

15 Claims, 4 Drawing Sheets

APPARATUS FOR DRIVING LIGHT EMITTING DEVICE USING PULSE-WIDTH MODULATION

CROSS-REFERENCE TO RELATED APPLICATIONS

This application claims the priority of Korean Patent Application No. 10-2009-0125656 filed on Dec. 16, 2009, in the Korean Intellectual Property Office, the disclosure of which is incorporated herein by reference.

BACKGROUND OF THE INVENTION

1. Field of the Invention

The present invention relates to an apparatus for driving a light emitting device, which is applicable to an illumination device or a backlight unit (BLU), and more particularly, to an apparatus for driving a light emitting device using a pulse-width modulation (PWM), in which a driving control transistor provided in each channel in order to control the driving of a multi-channel light emitting device operates in a PWM scheme.

2. Description of the Related Art

Light emitting devices (LEDs) have been applied in various fields, for example, illumination devices or backlight units, and their applications are currently being expanded.

In such LED backlight units, a multi-channel LED driving scheme is used for a local dimming function and a scanning function. Also, a linear scheme is used for maintaining a constant level of brightness.

The linear scheme is advantageous in terms of price, but is problematic in terms of heat generation in a driver IC due to an LED forward voltage (VF) deviation between channels. Thus, there is a limitation in embedding a multi-channel LED driver circuit into an IC.

A conventional multi-channel LED driver circuit has a plurality of channels there inside in order to drive a plurality of LEDs, and senses a current flowing through each channel and controls a current in a linear scheme.

Meanwhile, due to the LED forward voltages deviation, different voltages are applied to LED strings of the multi-channels. An operating voltage (Vcc) is controlled by feeding back the lowest LED string voltage.

However, in the conventional multi-channel LED driver circuit, the forward voltage deviation exists between the LED strings, and a high voltage is applied to LED driving control elements (transistors) by the forward voltage deviation. Thus, a great deal of heat is generated in the driving control elements.

Due to the heat generation in the driving control elements, there is a limitation in embedding multi-channels into the IC. Due to the distribution of the IC, an interchannel matching characteristic is degraded. There is a need a compensation circuit for solving those problems, which will increase the price of the device.

SUMMARY OF THE INVENTION

An aspect of the present invention provides an apparatus for driving an LED, which is capable of reducing heat generation in driving control elements, regardless of an LED forward voltage deviation between channels, and improving an interchannel current matching characteristic by operating driving control transistors, which are installed in each channel in order to control the driving of a multi-channel LED, in a PWM scheme.

According to an embodiment of the present invention, there is provided an apparatus for driving an LED, including: a first driving control element controlling a current flowing through a first LED channel, which is connected to an operating voltage terminal and includes a plurality of LEDs, in response to a first pulse-width modulated control signal; a first current detection unit connected between the first driving control element and a ground terminal and detecting the current flowing through the first LED channel; a first effective value detection unit detecting an effective value of the current detected by the first current detection unit; a first reference signal generation unit generating a preset reference signal having a sawtooth waveform; and a first comparison unit comparing the reference signal from the first reference signal generation unit with the effective value from the first effective value detection unit.

The first driving control element may be connected between the first LED channel and the first current detection unit, and may include an NMOS transistor having a drain connected to the first LED channel, a gate receiving the first control signal from the first comparison unit, and a source connected to the first current detection unit.

The first current detection unit may include a resistor connected between the first driving control element and the ground terminal.

The first comparison unit may include an operational amplifier having an inverting input terminal receiving the reference signal from the first reference signal generation unit, a noninverting input terminal receiving the effective value from the first effective value detection unit, and an output terminal outputting the first control signal to the first driving control element, the first control signal being pulse-width modulated by comparing the reference signal inputted through the inverting input terminal with the effective value inputted through the noninverting input terminal.

The first comparison unit may be enabled when a dimming PWM signal is at a high level, and may be disabled when the dimming PWM signal is at a low level.

According to another embodiment of the present invention, there is provided an apparatus for driving an LED, including: first to nth driving control elements controlling currents flowing through first to nth LED channels, which are connected in parallel to an operating voltage terminal and include a plurality of LEDs, in response to first to nth pulse-width modulated control signals; first to nth current detection units connected between the first to nth driving control elements and a ground terminal, and detecting currents flowing through the first to nth LED channels; first to nth effective value detection units detecting the effective values of the currents detected by the first to nth current detection units; first to nth reference signal generation units generating preset reference signals having sawtooth waveforms; and first to nth comparison units comparing the reference signals from the first to nth reference signal generation units with the effective values from the first to nth effective value detection units, and generating the first to nth pulse-width modulated control signals to the first to nth driving control elements.

The first to nth driving control element may be connected between the first to nth LED channels and the first to nth current detection units, and comprise NMOS transistors having drains connected to the first to nth LED channels, gates receiving the first to nth control signals from the first to nth comparison units, and sources connected to the first to nth current detection units, respectively.

The first to nth current detection units may include resistors connected between the first to nth driving control elements and the ground terminal, respectively.

The first to nth comparison units may include operational amplifiers inverting input terminals receiving the reference signals from the first to nth reference signal generation units, noninverting input terminals receiving the effective values from the first to nth effective value detection units, and output terminals outputting the first to nth control signals to the first to nth driving control elements, the first to nth control signals being pulse-width modulated by comparing the reference signals inputted through the inverting input terminals with the effective values inputted through the noninverting input terminals, respectively.

The first to nth reference signal generation units may generate the first to nth reference signals, which are synchronized with one another and have the same frequency, respectively.

According to another embodiment of the present invention, there is provided an apparatus for driving an LED, including: first to nth driving control elements controlling currents flowing through first to nth LED channels, which are connected in parallel to an operating voltage terminal and include a plurality of LEDs, in response to first to nth pulse-width modulated control signals; first to nth current detection units connected between the first to nth driving control elements and a ground terminal, and detecting currents flowing through the first to nth LED channels; first to nth effective value detection units detecting the effective values of the currents detected by the first to nth current detection units; first to nth reference signal generation units generating preset reference signals having sawtooth waveforms; and first to nth comparison units enabled in response to a dimming PWM signal, and comparing the reference signals from the first to nth reference signal generation units with the effective values from the first to nth effective value detection units, and generating the first to nth pulse-width modulated control signals to the first to nth driving control elements.

The first to nth driving control element may be connected between the first to nth LED channels and the first to nth current detection units, and may include NMOS transistors having drains connected to the first to nth LED channels, gates receiving the first to nth control signals from the first to nth comparison units, and sources connected to the first to nth current detection units, respectively.

The first to nth current detection units may include resistors connected between the first to nth driving control elements and the ground terminal, respectively.

The first to nth comparison units may include operational amplifiers inverting input terminals receiving the reference signals from the first to nth reference signal generation units, noninverting input terminals receiving the effective values from the first to nth effective value detection units, and output terminals outputting the first to nth control signals to the first to nth driving control elements, the first to nth control signals being pulse-width modulated by comparing the reference signals inputted through the inverting input terminals with the effective values inputted through the noninverting input terminals, respectively.

The first to nth reference signal generation units may generate the first to nth reference signals, which are synchronized with one another and have the same frequency, respectively.

The dimming PWM signal may be branched and provided to the first to nth comparison units.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
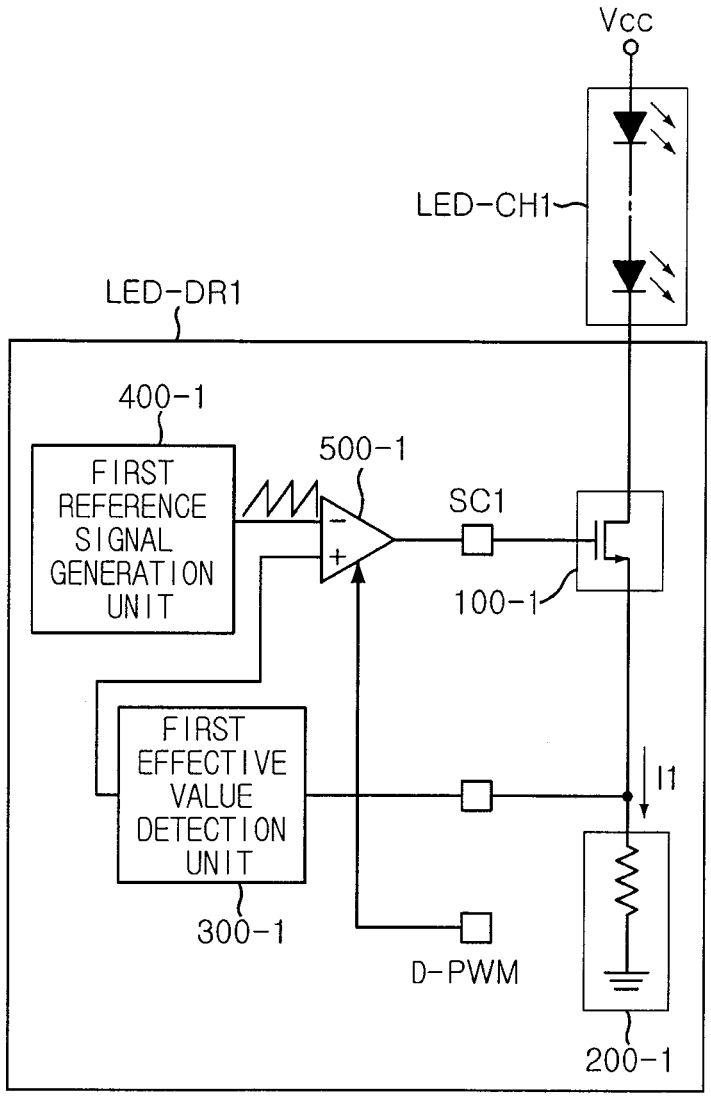
FIG. 1 is a block diagram of an apparatus for driving an LED according to an embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the thicknesses of layers and regions are exaggerated for clarity. Like reference numerals in the drawings denote like elements, and thus their description will be omitted.

FIG. 1 is a block diagram of an apparatus for driving alight emitting device (LED) according to an embodiment of the present invention. Referring to FIG. 1, an apparatus for driving an LED according to an embodiment of the present invention a first driving control element 100-1, a first current detection unit 200-1, a first effective value detection unit 300-1, a first reference signal generation unit 400-1, and a first comparison unit 500-1. The first driving control element 100-1 controls a current flowing through a first LED channel LED-CH1, which is connected to an operating voltage (Vcc) terminal and includes a plurality of LEDs, in response to a first pulse-width modulated control signal SC1. The first current detection unit 200-1 is connected between the first driving control element 100-1 and a ground terminal, and detects a current flowing through the first LED channel LED-CH1. The first effective value detection unit 300-1 detects an effective value of the current detected by the current detection unit 200-1. The first reference signal generation unit 400-1 generates a preset reference voltage having a sawtooth waveform. The first comparison unit 500-1 compares the reference signal from the first reference voltage generation unit 400-1 with the effective value from the first effective value detection unit 300-1, and generates the first pulse-width modulated control signal SC1 to the first driving control element 100-1.

The first driving control element 100-1 is connected between the first LED channel LED-CH1 and the first current detection unit 200-1. The first driving control element 100-1 may include an NMOS transistor having a drain connected to the first LED channel LED-CH1, a gate receiving the first control signal SC1 from the first comparison unit 500-1, and a source connected to the first current detection unit 200-1.

The first current detection unit 200-1 may include a resistor connected between the first driving control element 100-1 and the ground terminal.

The first comparison unit 500-1 may include an operational amplifier having an inverting input terminal receiving the reference signal from the first reference signal generation unit 400-1, a noninverting input terminal receiving the effective value from the first effective value detection unit 300-1, and an output terminal outputting the first control signal SC1 to the first driving control element 100-1, wherein the first control signal SC1 is pulse-width modulated by comparing the reference signal inputted through the inverting input terminal with the effective value inputted through the noninverting input terminal.

The first comparison unit 500-1 may be configured to be enabled in response to a dimming PWM signal D-PWM. The first comparison unit 500-1 may be enabled when the dimming PWM signal D-PWM is at a high level and may be disabled when the dimming PWM signal D-PWM is at a low level.

Figure 2:
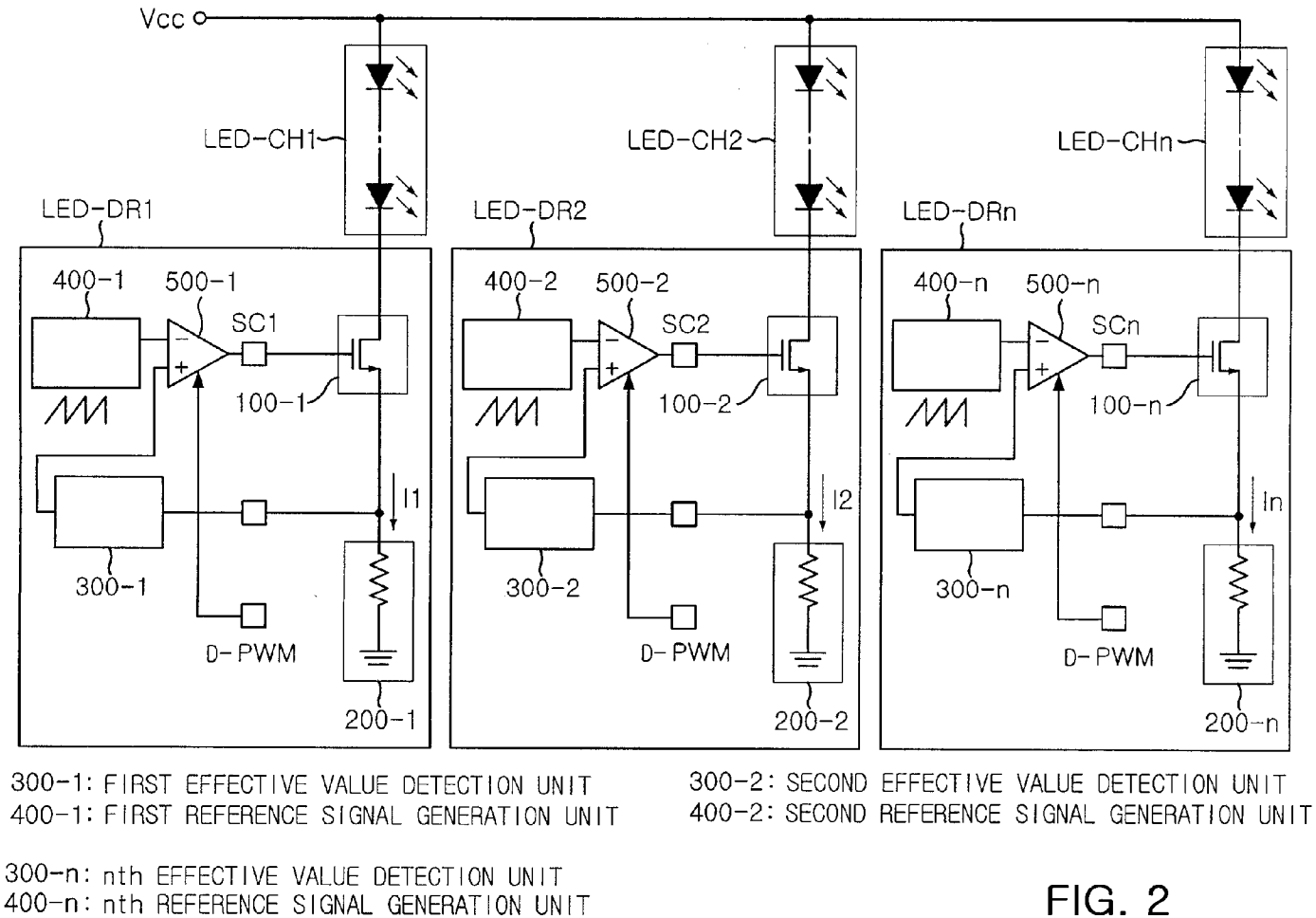
FIG. 2 is a block diagram of an apparatus for driving an LED according to another embodiment of the present invention.

FIG. 2 is a block diagram of an apparatus for driving an LED according to another embodiment of the present invention. Referring to FIG. 2, an apparatus for driving an LED according to another embodiment of the present invention includes first to nth driving control elements 100-1 to **100-*n* controlling currents flowing through first to nth LED channels LED-CH1 to LED-CHn, which are connected in parallel to an operating voltage (Vcc) terminal and include a plurality of LEDs, in response to first to nth pulse-width modulated control signals SC1** to SCn.

The apparatus for driving the LED may further include first to nth current detection units 200-1 to **200-*n* which are connected between the first to nth driving control elements 100-1 to 100-*n* and a ground terminal, and detect currents flowing through the first to nth LED channels LED-CH1** to LED-CHn.

The apparatus for driving the LED may further include first to nth effective value detection units 300-1 to **300-*n*, and first to nth reference signal generation units 400-1 to 400-*n*. The first to nth effective value detection units 300-1 to 300-*n* detect effective values of the currents detected by the first to nth current detection units 200-1 to 200-*n*. The first to nth reference signal generation units 400-1 to 400-*n*** generate preset reference signals having sawtooth waveforms.

The apparatus for driving the LED may further include first to nth comparison units 500-1 to **500-*n* which compare the reference signals from the first to nth reference signal generation units 400-1 to 400-*n* with the effective values from the first to nth effective value detection units 300-1 to 300-*n*, and generate the first to nth control signals SC1 to SCn to the first to nth driving control elements 100-1 to 100-*n***.

The first to nth comparison units 500-1 to **500-*n* may be configured to be enabled or disabled in response to a dimming PWM signal D-PWM. The first to nth comparison units 500-1 to 500-*n*** may be enabled when the PWM signal is at a high level and may be disabled when the PWM signal is at a low level.

The apparatus for driving the LED may further include first to nth driver circuits LED-DR1 to LED-DRn which drive the LEDs included in the first to nth LED channels LED-CH1 to LED-CHn.

The first driver circuit LED-DR1 may include the first driving control element 100-1, the first current detection unit 200-1, the first effective value detection unit 300-1, the first reference signal generation unit 400-1, and the first comparison unit 500-1 in order to drive the plurality of LEDs included in the first LED channel LED-CH1.

The first driving control element 100-1 is connected between the first LED channel LED-CH1 and the first current detection unit 200-1. The first driving control element 100-1 may include an NMOS transistor having a drain connected to the first LED channel LED-CH1, a gate receiving the first control signal SC1 from the first comparison unit 500-1, and a source connected to the first current detection unit 200-1.

The first current detection unit 200-1 may include a resistor connected between the first driving control element 100-1 and the ground terminal.

The first comparison unit 500-1 may include an operational amplifier having an inverting input terminal receiving the reference signal from the first reference signal generation unit 400-1, a noninverting input terminal receiving the effective value from the first effective value detection unit 300-1, and an output terminal outputting the first control signal SC1 to the first driving control element 100-1, wherein the first control signal SC1 is pulse-width modulated by comparing the reference signal inputted through the inverting input terminal with the effective value inputted through the noninverting input terminal.

The second driver circuit LED-DR2 may include the second driving control element 100-2, the second current detection unit 200-2, the second effective value detection unit 300-2, the second reference signal generation unit 400-2, and the second comparison unit 500-2 in order to drive the plurality of LEDs included in the second LED channel LED-CH2.

The second driving control element 100-2 is connected between the second LED channel LED-CH2 and the second current detection unit 200-2. The second driving control element 100-2 may include an NMOS transistor having a drain connected to the second LED channel LED-CH2, a gate receiving the second control signal SC2 from the second comparison unit 500-2, and a source connected to the second current detection unit 200-2.

The second current detection unit 200-2 may include a resistor connected between the second driving control element 100-2 and the ground terminal.

The second comparison unit 500-2 may include an operational amplifier having an inverting input terminal receiving the reference signal from the second reference signal generation unit 400-2, a noninverting input terminal receiving the effective value from the second effective value detection unit 300-2, and an output terminal outputting the second control signal SC2 to the second driving control element 100-2, wherein the second control signal SC2 is pulse-width modulated by comparing the reference signal inputted through the inverting input terminal with the effective value inputted through the noninverting input terminal.

The nth driver circuit LED-DRn may include the nth driving control element **100-*n*, the nth current detection unit 200-*n*, the nth effective value detection unit 300-*n*, the nth reference signal generation unit 400-*n*, and the nth comparison unit 500-*n*** in order to drive the plurality of LEDs included in the nth LED channel LED-CHn.

The nth driving control element **100-*n* is connected between the nth LED channel LED-CHn and the nth current detection unit 200-*n*. The nth driving control element 100-*n* may include an NMOS transistor having a drain connected to the nth LED channel LED-CHn, a gate receiving the nth control signal SCn from the nth comparison unit 500-*n*, and a source connected to the nth current detection unit 200-*n***.

The nth current detection unit **200-*n* may include a resistor connected between the nth driving control element 100-*n*** and the ground terminal.

The nth comparison unit **500-*n* may include an operational amplifier having an inverting input terminal receiving the reference signal from the nth reference signal generation unit 400-*n*, a noninverting input terminal receiving the effective value from the nth effective value detection unit 300-*n*, and an output terminal outputting the nth control signal SCn to the nth driving control element 100-*n***, wherein the nth control signal SCn is pulse-width modulated by comparing the reference signal inputted through the inverting input terminal with the effective value inputted through the noninverting input terminal.

The first to nth reference signal generation units 400-1 to **400-*n*** may be configured to generate the first to nth reference signals which are synchronized with one another and have the same frequency, respectively.

The dimming PWM signal D-PWM may be branched and provided to the first to nth comparison units 500-1 to **500-*n***.

Figure 3:
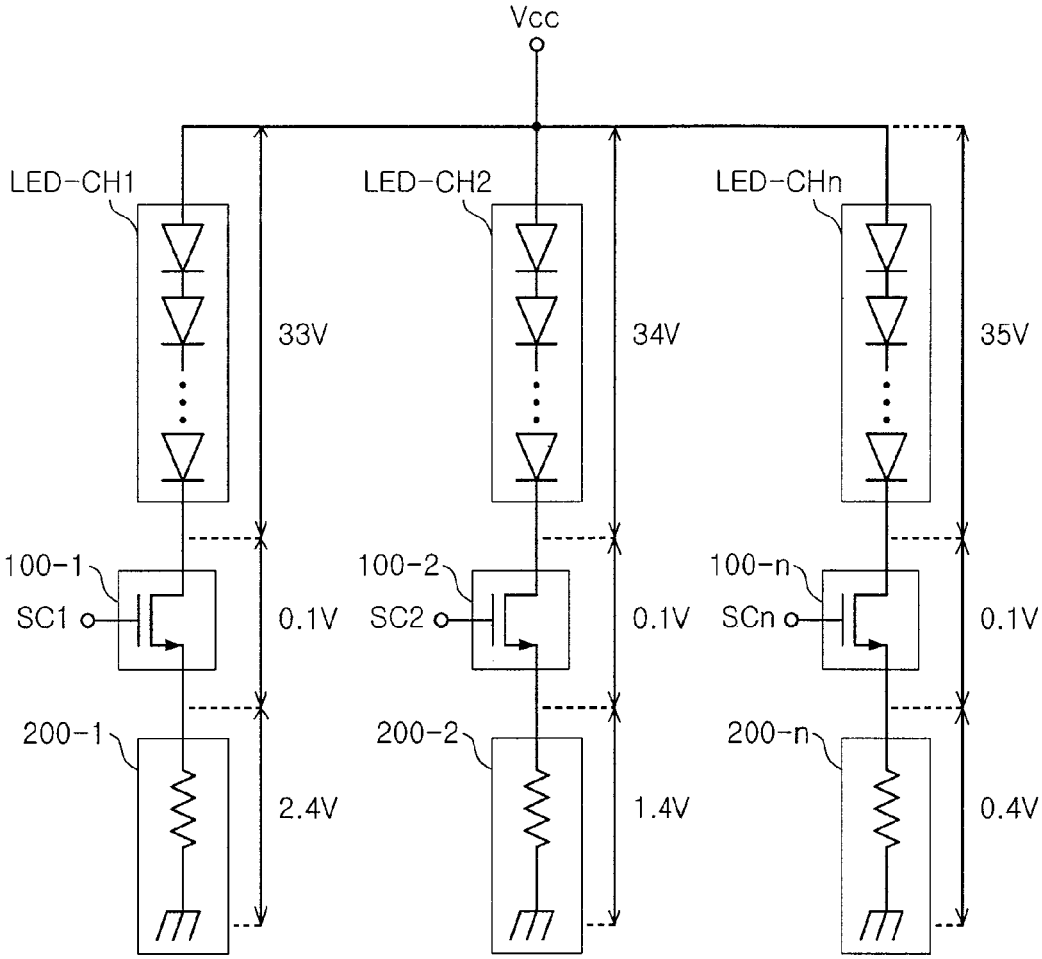
FIG. 3 illustrates a node voltage of each channel in the apparatus for driving the LED.

FIG. 3 illustrates a node voltage of each channel in the apparatus for driving the LED. In FIG. 3, when the operating voltage Vcc is 35.5 V, 35.5 V is applied to a node composed of the first LED channel LED-CH1, the first driving control element 100-1, and the first current detection unit 200-1. Also, 35.5 V is applied to a node composed of the second LED channel LED-CH2, the second driving control element 100-2, and the second current detection unit 200-2. 35.5 V is applied to a node composed of the nth LED channel LED-CHn, the nth driving control element **100-*n*, and the nth current detection unit 200-*n***.

Accordingly, it can be seen that a different voltage is applied to each node, depending on the LED forward voltage deviation between the channels.

Figure 4:
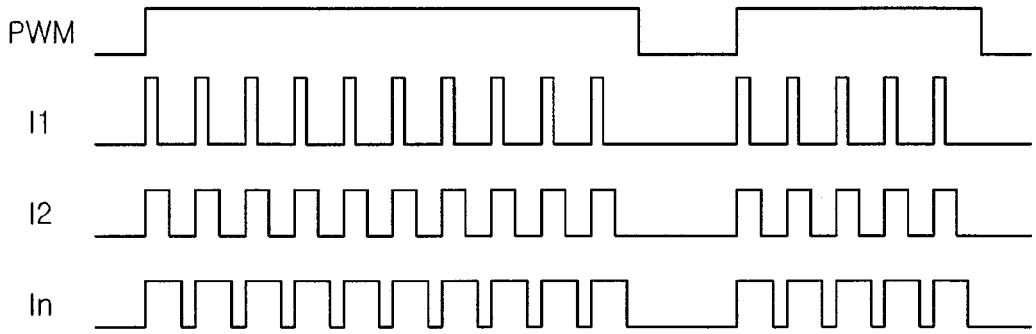
FIG. 4 is a timing chart of signals used in the embodiments of the present invention.

FIG. 4 is a timing chart of the signals used in the apparatus for driving the LED. In FIG. 4, D-PWM represents the dimming PWM signal, and I1 to In represent the currents flowing through the first to nth current detection units 200-1 to **200-*n***, respectively.

The operation and effects of the apparatus for driving the LED according to the embodiments of the present invention will be described below in detail with reference to the accompanying drawings.

First, the apparatus for driving the LED according to an embodiment of the present invention will now be described.

Referring to FIG. 1, the apparatus for driving the LED includes the first driver circuit LED-DR1 in order to drive the plurality of LEDs included in the first LED channel LED-CH1. The operation of the first driver circuit LED-DR1 will be described.

When the operating voltage Vcc is supplied to the first LED channel LED-CH1, the LEDs of the first LED channel LED-CH1 operate. At this time, the apparatus for driving the LED controls the current flowing through the LEDs of the first LED channel LED-CH1. That is, the apparatus for driving the LED controls the current flowing through the first LED channel LED-CH1 while the LEDs of the first LED channel LED-CH1 are in a turned-on state.

More specifically, the first driving control element 100-1 controls the current flowing through the first LED channel LED-CH1 including the plurality of LEDs in response to the first pulse-width modulated control signal SC1.

In one implementation example, as illustrated in FIG. 1, the first driving control element 100-1 may include an NMOS transistor which is configured to be switched in a PWM scheme according to the first pulse-width modulated control signal SC1 outputted from the first comparison unit 500-1. In this manner, the current flowing through the NMOS transistor may be adjusted.

The first current detection unit 200-1 may include a resistor which is connected between the first driving control element 100-1 and the ground terminal, and detects the current flowing through the first LED channel LED-CH1 and provides the detected current to the first effective value detection unit 300-1.

The first effective value detection unit 300-1 detects the effective value of the current detected by the first current detection unit 200-1, and provides the detected effective value to the noninverting input terminal of the first comparison unit 500-1.

The first reference signal generation unit 400-1 generates the preset reference signal having the sawtooth waveform to the inverting input terminal of the first comparison unit 500-1.

The first comparison unit 500-1 compares the reference signal from the first reference signal generation unit 400-1 with the effective value from the first effective value detection unit 300-1, and generates the first pulse-width modulated control signal SC1 to the first driving control element 100-1.

The first comparison unit 500-1 may be implemented with an operational amplifier. In this case, the first comparison unit 500-1 compares the reference signal inputted through the inverting input terminal with the effective value inputted through the noninverting input terminal, and outputs the first pulse-width modulated control signal SC1 to the first driving control element 100-1.

The first comparison unit 500-1 outputs a high level signal when the effective value is higher than the level of the reference signal, and outputs a low level signal when the effective value is not higher than the level of the reference signal. Consequently, the first comparison unit 500-1 outputs the first pulse-width modulated control signal SC1, whose pulse width is varied according to the magnitude of the effective value, to the first driving control element 100-1.

In addition, the first comparison unit 500-1 is enabled or disabled in response to the external dimming PWM signal D-PWM. That is, when the dimming PWM signal D-PWM is at a high level, the first comparison unit 500-1 is enabled to perform the above-described operation. When the dimming PWM signal D-PWM is at a low level, the first comparison unit 500-1 is disabled.

The apparatus for driving the LED according to another embodiment of the present invention will be described below with reference to FIGS. 2 to 4.

Referring to FIG. 2, the apparatus for driving the LED includes first to nth driver circuits LED-DR1 to LED-DRn in order to drive the plurality of LEDs included in the first to nth LED channels LED-CH1 to LED-CHn.

The above description of the foregoing embodiment is equally applied to the operation of the first driver circuit LED-DR1 which drives the plurality of LEDs included in the first LED channel LED-CH1.

Next, the operation of the second driver circuit LED-DR2 driving the plurality of LEDs included in the second LED channel LED-CH2 of the apparatus for driving the LED will be described below.

Referring to FIG. 2, when the operating voltage Vcc is supplied to the second LED channel LED-CH2, the LEDs of the second LED channel LED-CH2 operate. At this time, the apparatus for driving the LED controls the current flowing through the LEDs of the second LED channel LED-CH2. That is, the apparatus for driving the LED controls the current flowing through the second LED channel LED-CH2 while the LEDs of the second LED channel LED-CH2 are in a turned-on state.

More specifically, the second driving control element 100-2 controls the current flowing through the second LED channel LED-CH2 including the plurality of LEDs in response to the second pulse-width modulated control signal SC2.

In one implementation example, as illustrated in FIG. 2, the second driving control element 100-2 may include an NMOS transistor which is configured to be switched in a PWM scheme according to the second pulse-width modulated control signal SC2 outputted from the second comparison unit 500-2. In this manner, the current flowing through the NMOS transistor may be adjusted.

The second current detection unit 200-2 may include a resistor which is connected between the second driving control element 100-2 and the ground terminal, and detects the current flowing through the second LED channel LED-CH2 and provides the detected current to the second effective value detection unit 300-2.

The second effective value detection unit 300-2 detects the effective value of the current detected by the second current detection unit 200-2, and provides the detected effective value to the noninverting input terminal of the second comparison unit 500-2.

The second reference signal generation unit 400-2 generates the preset reference signal having the sawtooth waveform, and provides the reference signal to the inverting input terminal of the second comparison unit 500-2.

The second comparison unit 500-2 compares the reference signal from the second reference signal generation unit 400-2 with the effective value from the second effective value detection unit 300-2, and generates the second pulse-width modulated control signal SC2 to the second driving control element 100-2.

The second comparison unit 500-2 may be implemented with an operational amplifier. In this case, the second comparison unit 500-2 compares the reference signal inputted through the inverting input terminal with the effective value inputted through the noninverting input terminal, and outputs the second pulse-width modulated control signal SC2 to the second driving control element 100-2.

The second comparison unit 500-2 outputs a high level signal when the effective value is higher than the level of the reference signal, and outputs a low level signal when the effective value is not higher than the level of the reference signal. Consequently, the second comparison unit 500-2 outputs the second pulse-width modulated control signal SC2, whose pulse width is varied according to the magnitude of the effective value, to the second driving control element 100-2.

In addition, the second comparison unit 500-2 is enabled in response to the external dimming PWM signal D-PWM. That is, when the dimming PWM signal D-PWM is at a high level, the second comparison unit 500-2 is enabled to perform the above-described operation. When the dimming PWM signal D-PWM is at a low level, the second comparison unit 500-2 is disabled.

Next, the operation of the nth driver circuit LED-DRn driving the plurality of LEDs included in the nth LED channel LED-CHn of the apparatus for driving the LED will be described below.

Referring to FIG. 2, when the operating voltage Vcc is supplied to the nth LED channel LED-CHn, the LEDs of the nth LED channel LED-CHn operate. At this time, the apparatus for driving the LED controls the current flowing through the LEDs of the nth LED channel LED-CHn. That is, the apparatus for driving the LED controls the current flowing through the nth LED channel LED-CHn while the LEDs of the nth LED channel LED-CHn are in a turned-on state.

More specifically, the nth driving control element **100-*n*** controls the current flowing through the nth LED channel LED-CHn including the plurality of LEDs in response to the nth pulse-width modulated control signal SCn.

In one implementation example, as illustrated in FIG. 2, the nth driving control element **100-*n* may include an NMOS transistor which is configured to be switched in a PWM scheme according to the nth pulse-width modulated control signal SCn outputted from the nth comparison unit 500-*n***. In this manner, the current flowing through the NMOS transistor may be adjusted.

The nth current detection unit **200-*n* may include a resistor which is connected between the nth driving control element 100-*n* and the ground terminal, and detects the current flowing through the nth LED channel LED-CHn and provides the detected current to the nth effective value detection unit 300-*n***.

The nth effective value detection unit **300-*n* detects the effective value of the current detected by the nth current detection unit 200-*n*, and provides the detected effective value to the noninverting input terminal of the nth comparison unit 500-*n***.

The nth reference signal generation unit **400-*n* generates the preset reference signal having the sawtooth waveform, and provides the reference signal to the inverting input terminal of the nth comparison unit 500-2**.

The nth comparison unit **500-*n* compares the reference signal from the nth reference signal generation unit 400-*n* with the effective value from the nth effective value detection unit 300-*n*, and generates the nth pulse-width modulated control signal SCn to the nth driving control element 100-*n***.

The nth comparison unit **500-*n* may be implemented with an operational amplifier. In this case, the nth comparison unit 500-*n* compares the reference signal inputted through the inverting input terminal with the effective value inputted through the noninverting input terminal, and outputs the nth pulse-width modulated control signal SCn to the nth driving control element 100-*n***.

The nth comparison unit **500-*n* outputs a high level signal when the effective value is higher than the level of the reference signal, and outputs a low level signal when the effective value is not higher than the level of the reference signal. Consequently, the nth comparison unit 500-*n* outputs the nth pulse-width modulated control signal SCN, whose pulse width is varied according to the magnitude of the effective value, to the nth driving control element 100-*n***.

In addition, the nth comparison unit **500-*n* is enabled or disabled in response to the external dimming PWM signal D-PWM. That is, when the dimming PWM signal D-PWM is at a high level, the nth comparison unit 500-*n* is enabled to perform the above-described operation. When the dimming PWM signal D-PWM is at a low level, the nth comparison unit 500-*n*** is disabled.

The first to nth reference signal generation units 400-1 to **400-*n* generate the first to nth reference signals which are synchronized with one another and have the same frequency, respectively. Accordingly, the first to nth driver circuits LED-DR1** to LED-DRn may operate in synchronization with one another.

In addition, the dimming PWM signal D-PWM may be branched and provided to the first to nth comparison units 500-1 to **500-*n*. Thus, the synchronous operation of the first to nth driver circuits LED-DR1** to LED-DRn may be further ensured.

A node voltage of each channel will be described below with reference to FIG. 3. In FIG. 3, when the operating voltage Vcc is 35.5 V, 35.5 V is applied to a node composed of the first LED channel LED-CH1, the first driving control element 100-1, and the first current detection unit 200-1. 35.5 V is applied to a node composed of the second LED channel LED-CH2, the second driving control element 100-2, and the second current detection unit 200-2. 35.5 V is applied to a node composed of the nth LED channel LED-CHn, the nth driving control element **100-*n*, and the nth current detection unit 200-*n***.

When it is assumed that 33 V, 34 V and 35 V are applied to the first, second and nth LED channels LED-CH1, LED-CH2 and LED-CHn due to the LED forward voltage deviation, about 0.1 V is substantially equally applied to the first driving control element 100-1, the second driving control element 100-2, and the nth driving control element **100-*n* according to the switching operations which are performed in response to the first, second and nth pulse-width modulated control signals SC1, SC2 and SC3**.

As described above, since the voltages applied to the first, second and nth driving control elements 100-1, 100-2 and **100-*n*** are lowered by about 0.1 V, heat generation is reduced and thus the elements can be embedded into the IC.

2.4 V, 1.4 V and 0.4 V are applied to the first current detection unit 200-1, the second current detection unit 200-2, and the nth current detection unit **200-*n***, respectively.

Referring to FIG. 4, when the resistors of the first to nth current detection units 200-1 to **200-*n* are equal to one another, different voltages are applied to the first to nth current detection units 200-1 to 200-*n*. Thus, the current I1 flowing through the first current detection unit 200-1, the current I2 flowing through the second current detection unit 200-2, and the current In flowing through the nth current detection unit 200-*n* become different in magnitude. Furthermore, the widths of the currents become different according to the pulse widths of the first, second and nth control signals SC1, SC2** and SCn.

As described above, the multi-channel LED is driven to make an average current constant by controlling the duty while sensing the current according to the LED forward voltage deviation between the channels and then comparing the sensed current with the reference signal. Furthermore, a superior interchannel current matching characteristic may be obtained by increasing the duty in the channel having a large forward voltage deviation and decreasing the duty in the channel having a small forward deviation. Moreover, a superior heat generation characteristic may be obtained by switching the LED current driving elements within the "PWM ON" duration. In this case, the limitation in embedding the multi-channels into the IC is reduced, and price competitiveness is also excellent in configuring the LED system.

In particular, an excellent interchannel current matching characteristic may be obtained, without compensation circuits, and the heat generation problem caused by the LED forward voltage deviation may be solved. Thus, the limitation in embedding the channels into the IC is reduced. Consequently, the optimal solution for configuring the LED BLU system may be provided.

As set forth above, according to exemplary embodiments of the invention, the driving control transistors, which are installed in each channel in order to control the driving of the multi-channel LED, are operated in the PWM scheme, thereby reducing the heat generation of the driving control elements, regardless of an LED forward voltage deviation between channels, and improving the interchannel current matching characteristic. Moreover, the driving control elements may be embedded into the IC.

While the present invention has been shown and described in connection with the exemplary embodiments, it will be apparent to those skilled in the art that modifications and variations can be made without departing from the spirit and scope of the invention as defined by the appended claims.

What is claimed is:

1. An apparatus for driving a light emitting device (LED), the apparatus comprising:

a first driving control element configured to control a current flowing through a first LED channel, which is connected to an operating voltage terminal and includes a plurality of LEDs, in response to a first pulse-width modulated control signal;

a first current detection unit connected between the first driving control element and a ground terminal, and configured to detect the current flowing through the first LED channel;

a first effective value detection unit configured to detect an effective value of the current detected by the first current detection unit;

a first reference signal generation unit configured to generate a preset reference signal having a sawtooth waveform; and a first comparison unit configured to compare the reference signal from the first reference signal generation unit with the effective value from the first effective value detection unit, wherein the first comparison unit is configured to be enabled when a dimming pulse-width-modulated (PWM) signal is at a high level, and disabled when the dimming PWM signal is at a low level.

2. The apparatus of claim 1, wherein the first driving control element is connected between the first LED channel and the first current detection unit, and comprises an NMOS transistor having a drain connected to the first LED channel, a gate receiving the first control signal from the first comparison unit, and a source connected to the first current detection unit.

3. The apparatus of claim 1, wherein the first current detection unit comprises a resistor connected between the first driving control element and the ground terminal.

4. An apparatus for driving a light emitting device (LED), the apparatus comprising:

a first driving control element configured to control a current flowing through a first LED channel, which is connected to an operating voltage terminal and includes a plurality of LEDs, in response to a first pulse-width modulated control signal;

a first current detection unit connected between the first driving control element and a ground terminal, and configured to detect the current flowing through the first LED channel;

a first effective value detection unit configured to detect an effective value of the current detected by the first current detection unit;

a first reference signal generation unit configured to generate a preset reference signal having a sawtooth waveform; and a first comparison unit configured to compare the reference signal from the first reference signal generation unit with the effective value from the first effective value detection unit, wherein the first comparison unit includes an operational amplifier having an inverting input terminal for receiving the reference signal from the first reference signal generation unit, a noninverting input terminal for receiving the effective value from the first effective value detection unit, and an output terminal for outputting the first control signal to the first driving control element, the first control signal is pulse-width modulated by comparing the reference signal inputted through the inverting input terminal with the effective value inputted through the noninverting input terminal, and the first comparison unit is configured to be enabled when a dimming pulse-width-modulated (PWM) signal is at a high level, and disabled when the dimming PWM signal is at a low level.

5. An apparatus for driving a light emitting device (LED), the apparatus comprising:

first to nth driving control elements controlling currents flowing through first to nth LED channels, which are connected in parallel to an operating voltage terminal and include a plurality of LEDs, in response to first to nth pulse-width modulated control signals, where n is an integer greater than 1;

first to nth current detection units connected between the first to nth driving control elements and a ground terminal, and detecting currents flowing through the first to nth LED channels;

first to nth effective value detection units detecting the effective values of the currents detected by the first to nth current detection units;

first to nth reference signal generation units generating preset reference signals having sawtooth waveforms; and first to nth comparison units comparing the reference signals from the first to nth reference signal generation units with the effective values from the first to nth effective value detection units, and generating the first to nth pulse-width modulated control signals to the first to nth driving control elements.

6. The apparatus of claim 5, wherein the first to nth driving control element are connected between the first to nth LED channels and the first to nth current detection units, and comprise NMOS transistors having drains connected to the first to nth LED channels, gates receiving the first to nth control signals from the first to nth comparison units, and sources connected to the first to nth current detection units, respectively.

7. The apparatus of claim 5, wherein the first to nth current detection units comprise resistors connected between the first to nth driving control elements and the ground terminal, respectively.

8. The apparatus of claim 5, wherein the first to nth comparison units comprise operational amplifiers inverting input terminals receiving the reference signals from the first to nth reference signal generation units, noninverting input terminals receiving the effective values from the first to nth effective value detection units, and output terminals outputting the first to nth control signals to the first to nth driving control elements, the first to nth control signals being pulse-width modulated by comparing the reference signals inputted through the inverting input terminals with the effective values inputted through the noninverting input terminals, respectively.

9. The apparatus of claim 5, wherein the first to nth reference signal generation units generate the first to nth reference signals, which are synchronized with one another and have the same frequency, respectively.

10. An apparatus for driving a light emitting device (LED), the apparatus comprising:

first to nth driving control elements controlling currents flowing through first to nth LED channels, which are connected in parallel to an operating voltage terminal and include a plurality of LEDs, in response to first to nth pulse-width modulated control signals, where n is an integer greater than 1;

first to nth current detection units connected between the first to nth driving control elements and a ground terminal, and detecting currents flowing through the first to nth LED channels;

first to nth effective value detection units detecting the effective values of the currents detected by the first to nth current detection units;

first to nth reference signal generation units generating preset reference signals having sawtooth waveforms; and first to nth comparison units enabled in response to a dimming pulse-width-modulated (PWM) signal, and comparing the reference signals from the first to nth reference signal generation units with the effective values from the first to nth effective value detection units, and generating the first to nth pulse-width modulated control signals to the first to nth driving control elements.

11. The apparatus of claim 10, wherein the first to nth driving control element are connected between the first to nth LED channels and the first to nth current detection units, and comprise NMOS transistors having drains connected to the first to nth LED channels, gates receiving the first to nth control signals from the first to nth comparison units, and sources connected to the first to nth current detection units, respectively.

12. The apparatus of claim 10, wherein the first to nth current detection units comprise resistors connected between the first to nth driving control elements and the ground terminal, respectively.

13. The apparatus of claim 10, wherein the first to nth comparison units comprise operational amplifiers inverting input terminals receiving the reference signals from the first to nth reference signal generation units, noninverting input terminals receiving the effective values from the first to nth effective value detection units, and output terminals outputting the first to nth control signals to the first to nth driving control elements, the first to nth control signals being pulse-width modulated by comparing the reference signals inputted through the inverting input terminals with the effective values inputted through the noninverting input terminals, respectively.

14. The apparatus of claim 10, wherein the first to nth reference signal generation units generate the first to nth reference signals, which are synchronized with one another and have the same frequency, respectively.

15. The apparatus of claim 10, wherein the dimming PWM signal is branched and provided to the first to nth comparison units.

* * * * *